US005304044A

United States Patent [19]

Wada et al.

[11] Patent Number: 5,304,044

[45] Date of Patent: Apr. 19, 1994

[54] HERMETIC COMPRESSOR

[75] Inventors: Satoshi Wada; Toshihiro Yamada, both of Kanagawa; Shuichi Yakushi, Yokohama; Hideki Otori, Kanagawa, all of Japan

[73] Assignee: Matsushita Refrigeration Company, Osaka, Japan

[21] Appl. No.: 665,414

[22] Filed: Mar. 6, 1991

[30] Foreign Application Priority Data

Mar. 6, 1990 [JP] Japan ..... 2-55269

[51] Int. Cl.[5] ..... F04B 39/00

[52] U.S. Cl. ..... 417/312; 181/403

[58] Field of Search ..... 417/312; 181/229, 403

[56] References Cited

U.S. PATENT DOCUMENTS

| | | | |
|---|---|---|---|
| 4,313,715 | 2/1982 | Richardson | 417/312 |
| 4,401,418 | 8/1983 | Fritchman | 417/312 |
| 4,415,060 | 11/1983 | Bar | 417/312 |
| 4,531,894 | 7/1985 | Kawai et al. | 417/312 |
| 4,582,468 | 7/1986 | Bar | 417/312 |
| 4,759,693 | 7/1988 | Outzen | 417/312 |
| 4,784,581 | 11/1988 | Fritchman | 417/312 |
| 4,784,583 | 11/1988 | Bar | 417/312 |
| 4,990,067 | 3/1991 | Sasano | 417/312 |
| 5,174,127 | 12/1992 | Harper | 417/312 |

FOREIGN PATENT DOCUMENTS

| | | | |
|---|---|---|---|
| 2-55277 | 11/1991 | Japan | 417/312 |
| 2-92458 | 12/1991 | Japan | 417/312 |
| 2-92462 | 12/1991 | Japan | 417/312 |
| 2-104328 | 1/1992 | Japan | 417/312 |

*Primary Examiner*—Richard A. Bertsch
*Assistant Examiner*—Peter Korytnyk
*Attorney, Agent, or Firm*—Amster, Rothstein & Ebenstein

[57] ABSTRACT

A hermetic compressor system includes a compressor and an electric drive resiliently supported in a closed housing. A metallic cylinder head is secured to the compressor and defines an insertion hole. The cylinder head has a suction chamber, which communicates with the insertion hole, and a discharge chamber integrally formed with and adjacent to the suction chamber. A suction muffler made of a synthetic resin or equivalent material of low thermal conductivity has a communicating duct extending through the insertion hole and partially disposed within the suction chamber. An opening is formed in the end of the communicating duct disposed within the suction chamber in a position facing a suction port leading a refrigerant gas into the compressor.

12 Claims, 5 Drawing Sheets

HERMETIC COMPRESSOR

BACKGROUND OF THE INVENTION

The present invention relates to a hermetic compressor and parts thereof, and more particularly to such a compressor for refrigerators.

In a reciprocating refrigerant compressor for cooling systems, such as a refrigerator or freezer, it is very desirable to improve compression efficiency. When the refrigerant gas recycled from the cooling system is expanded by heat within the compressor, the resultant reduced density gas must then be re-compressed by the compression cylinder, thereby decreasing the compression efficiency. One way to improve compression efficiency is to prevent the decrease of density within the compressor of the refrigerant gas recycled from the cooling system.

A specific example of such a system is disclosed in U.S. Pat. No. 4,531,894, wherein the refrigerant gas from the cooling system is guided directly to a suction muffler made of a synthetic resin of low thermal conductivity within the compressor, with the suction muffler being connected to a suction plenum communicating therewith via a metallic pipe. Another example, U.S. Pat. No. 4,401,418, discloses a compressor wherein the inlet of a suction muffler made of a synthetic resin of low thermal conductivity is formed in the shape of a horn for blowing of the suction gas, with the suction muffler being in communication with the suction plenum via a metallic pipe. In compressors of such types, however, because the metallic pipe has a high thermal conductivity and the cylinder head defining the suction plenum is made of a material of high thermal conductivity, such as cast iron or aluminum alloy, the suction gas is subject to substantial heating by the pipe and cylinder head.

In order to further reduce the effect of heat on the suction gas, European Patent No. 195486A2 and U.S. Pat. No. 4,784,581 propose compressors wherein a metal discharge chamber and a synthetic resin suction chamber are separately assembled to the valve plate of the cylinder block to minimize heat conduction therebetween. The flow passage or communicating duct (from the synthetic resin suction muffler to the synthetic resin suction plenum) is formed of synthetic resin and integral with the suction muffler, with the suction chamber or plenum being disposed at the leading end of the flow passage. However, in these systems, the suction chamber (at the leading end of the suction muffler) and the discharge chamber must be independently mounted and sealingly held in contact with their respective ports adjacent the cylinder head. In addition, if the contact between the suction port and the suction chamber is not completely airtight, suction noise is produced. Therefore, care must be exercised in ensuring a hermetic seal between the suction port and the suction chamber. Thus the cost of manufacture and assembly is relatively expensive.

Accordingly, it is an object of the present invention to provide a hermetic compressor of improved compression efficiency.

Another object is to provide such a compressor wherein an integral unitary metallic cylinder head defines both the suction chamber and the discharge chamber, but with minimal heating of suction gas in the suction chamber by the hotter gas in the discharge chamber.

A further object is to provide such a compressor wherein the suction muffler and cylinder head may be preassembled at the factory to minimize on site assembly work.

It is also an object to provide such a compressor wherein suction noise is minimized.

It is another object to provide such a compressor wherein the suction muffler is held against rotation relative to the cylinder head.

SUMMARY OF THE INVENTION

It has now been found that the above and related objects of the present invention are obtained in a hermetic compressor comprising a closed housing, with a compressor unit and an electric drive unit resiliently supported in the closed housing. An integral unitary cylinder head, preferably formed of metal, is secured to the compressor unit and defines an insertion hole, the cylinder head also defining a suction chamber communicating with the insertion hole and a discharge chamber. A suction muffler, preferably formed of a material of low thermal conductivity, has a communicating duct extending through the insertion hole and partially disposed within the suction chamber, the communicating duct terminating within the suction chamber adjacent a suction port leading refrigerant gas into the compressor unit.

In a preferred embodiment, the communicating duct is cylindrical, extends through the insertion hole, terminates adjacent a downstream wall of the suction chamber opposite the insertion hole, and has an opening in the suction chamber which faces the suction port. Preferably, the communicating duct includes collar means for limiting the depth of insertion of the communicating duct into the insertion hole and therefore into the suction chamber, the collar means in use effecting a substantially hermetic seal between the communicating duct and the insertion hole. Further, the downstream wall of the suction chamber (adjacent the downstream end of the communicating duct) is preferably recessed.

The present invention further encompasses a cylinder head and suction muffler assembly for a compressor unit wherein the cylinder head has an upwardly extending wall portion defining a first surface, the communicating duct is formed with a second surface abutting against the firs surface, and a resilient band biases the first and second surfaces together for fixing the communicating duct in position relative to the cylinder head and precluding relative rotation.

The present invention additionally encompasses a compressor unit comprising a cylinder head of high thermal conductivity defining a suction chamber and a discharge chamber, and a suction muffler of low thermal conductivity including a gas communicating duct extending into the suction chamber. The communicating duct acts as a thermal liner at least partially isolating the gas passing from the suction muffler into the suction chamber via the communicating duct from thermal contact with the discharge chamber while it is in the suction chamber.

Thus, in accordance with one preferred embodiment of the invention, heating of suction gas in a refrigerant compressor is successfully prevented by forming the flow passage from the suction muffler to the suction chamber in the cylinder head as a communicating duct made of a synthetic resin of low thermal conductivity, with the end of the communicating duct lying within the suction chamber being provided with an opening disposed facing the suction port of the compressor, so that the refrigerant gas may more easily flow into the suction port of the compressor.

Furthermore, in accordance with one preferred embodiment of the invention, the cylinder head is integrally formed with a discharge chamber and a suction chamber disposed adjacent the discharge chamber, the cylinder head having an insertion hole leading into the suction chamber and the communicating duct from the suction muffler passing through the insertion hole, whereby the assembling of the suction muffler with the cylinder head is facilitated.

In addition, the cylindrical communicating duct integral with the suction muffler is formed with a collar means, the communicating duct being inserted through the insertion hole in the cylinder head until the collar means abuts against the cylinder head, thereby effecting in use a substantially hermetic seal between the communicating duct and the insertion hole.

The wall extending from the cylinder head toward the suction muffler and disposed closer to the compressor is formed with a cutout for abutment against the compressor side of the communicating duct. Further, the wall is formed with a planar surface for abutment against a planar surface provided on the communicating duct of the suction muffler. A resilient band is secured to the cylinder head by bolt means for fixing the communicating duct against rotation. This construction ensures that rotation of the suction muffler is also precluded.

BRIEF DESCRIPTION OF THE DRAWING

The above brief description, as well as further objects and features of the present invention, will be more fully understood by reference to the following detailed description of the presently preferred, albeit illustrative embodiments of the present invention when taken in conjunction with the accompanying drawing wherein.

DETAILED DESCRIPTION OF THE PREFERRED EMBODIMENTS

Figure 1:
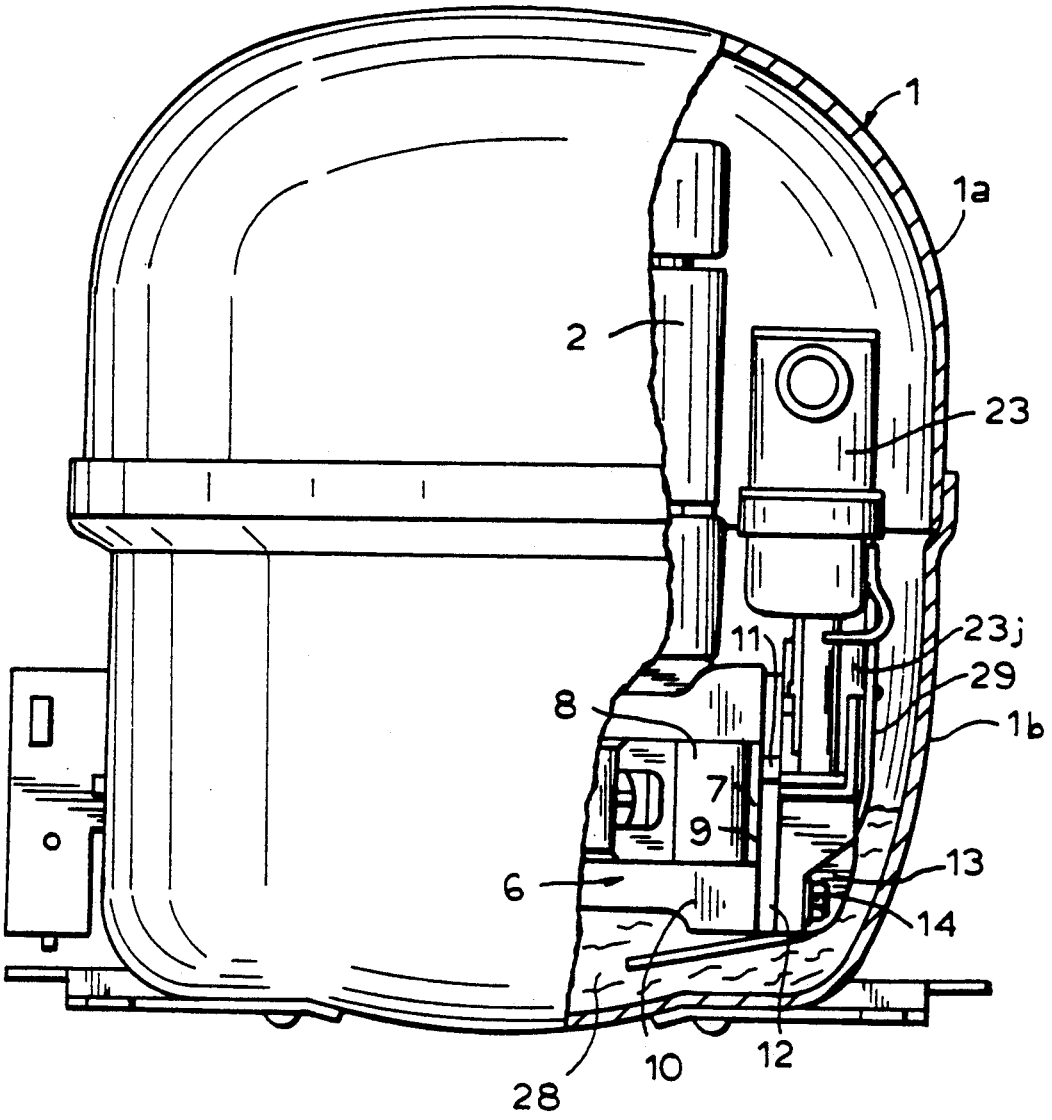
FIG. 1 is an elevational view, in cross-section, showing a hermetic refrigerant compressor embodying the principles of the present invention.
Figure 2:
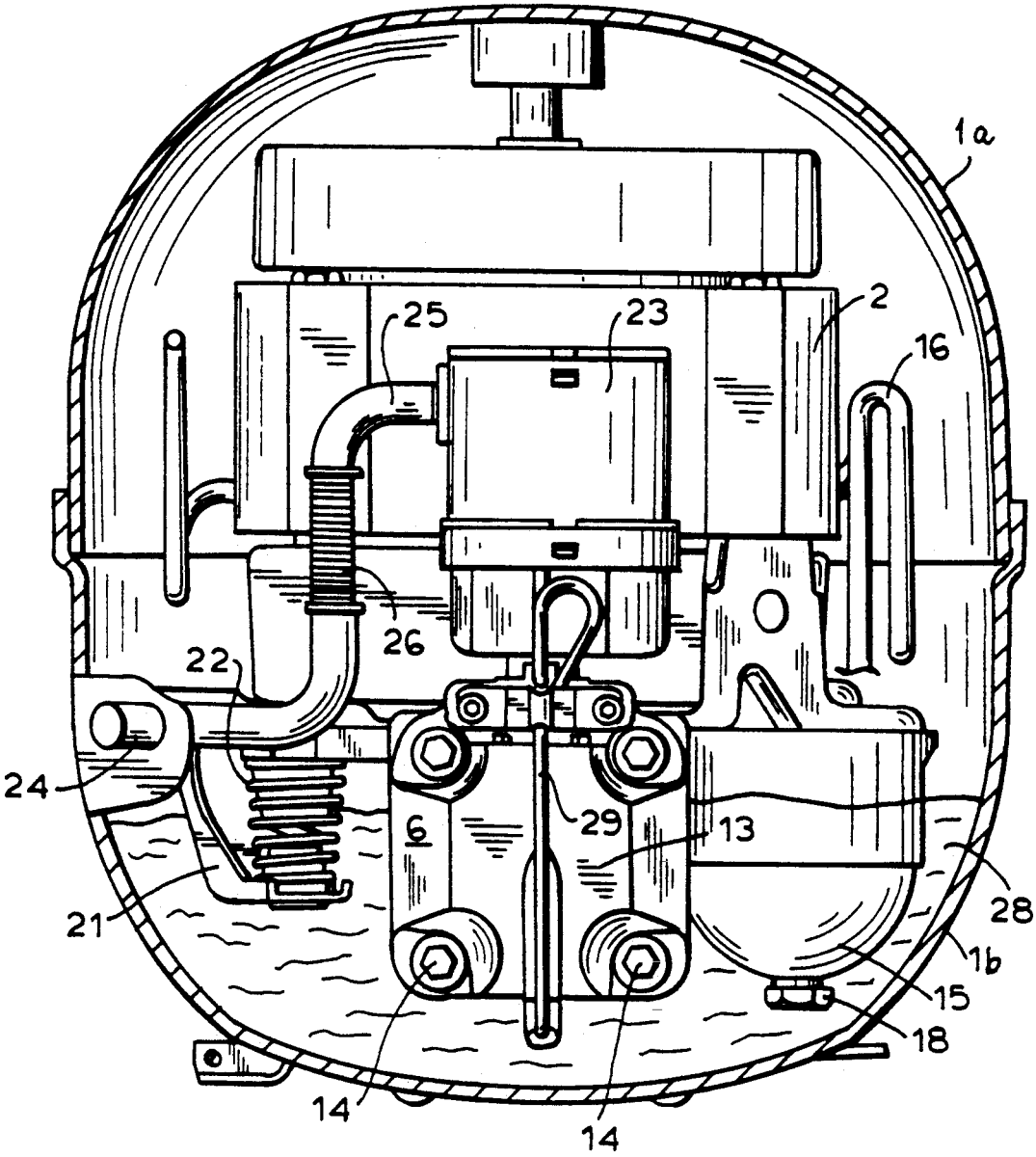
FIG. 2 is an elevational section view thereof.
Figure 3:
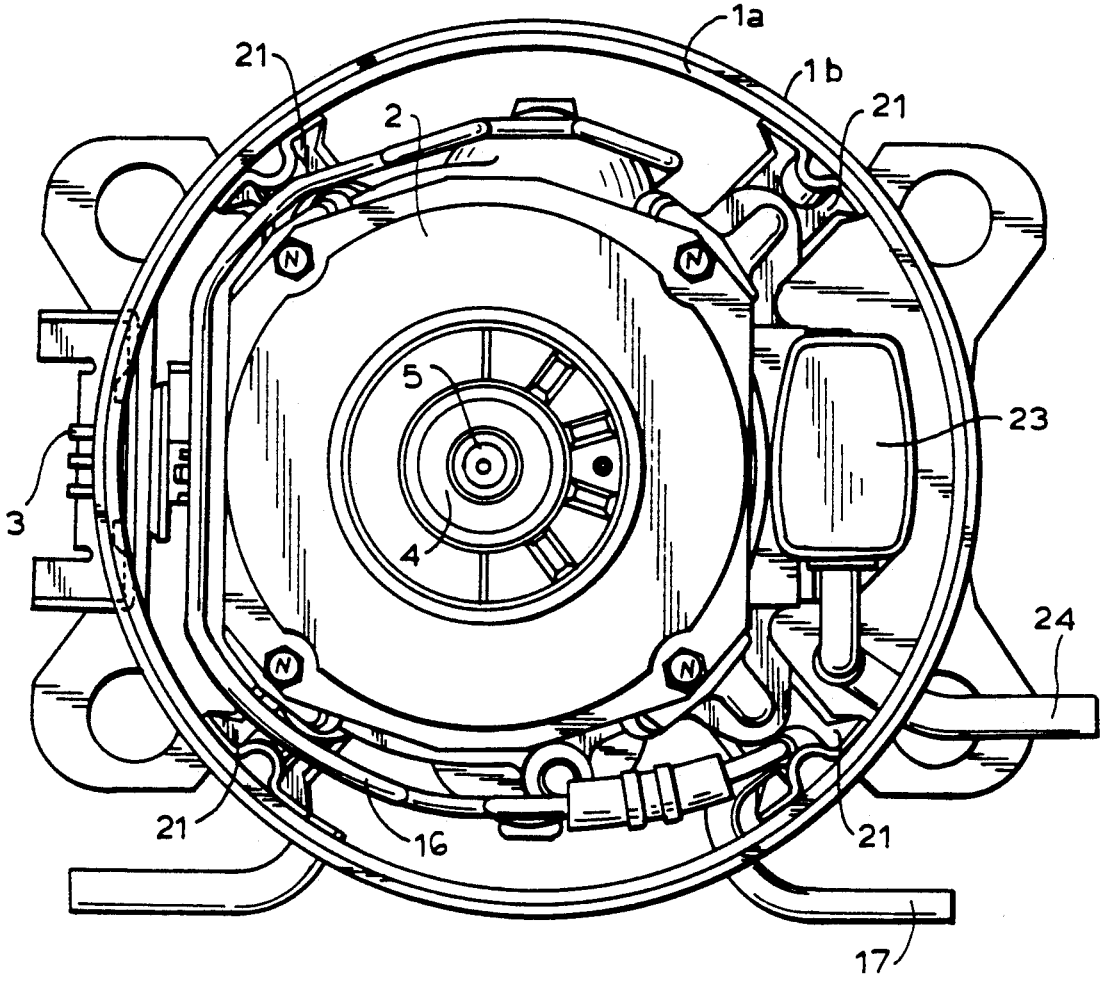
FIG. 3 is a plan sectional view thereof.

Referring to FIGS. 1-3 in particular, in a preferred embodiment of the present invention, a closed housing generally designated by the reference numeral 1 consists of an upper case 1*a* and a lower case 1*b*, each case being separately press-formed of iron and welded together on respective peripheral edges.

An electric drive unit 2 is disposed in an upper position within the closed housing 1 and electrically connected to a power plug 3 (see FIG. 3) installed within the lower case 1*b*. The drive unit 2 has a rotor 4 which is connected to a vertically extending crankshaft 5. A compressor unit 6 is disposed in a lower position within the closed housing 1, the compressor unit 6 having a cylinder block 10 including a cylinder 9 which has an opening 7 on one end and a piston 8 accommodated therein. The piston 8 is connected to the crankshaft 5 via a connecting rod (not shown) so that the rotation of the crankshaft 5 is transmitted to the piston 8 to move the latter in reciprocating motion. The end of cylinder 9 defining the opening 7 is closed by a valve plate 12 having a suction port 11, a discharge port (not shown), and a valve (not shown) disposed in each of the ports. The cylinder head 13 is secured to cylinder block 10 by means of screws 14.

A discharge muffler 15 receives a compressed refrigerant gas from the discharge port and discharges the refrigerant gas into a discharge pipe 17 (see FIG. 3) disposed in the lower case 1*b* through a connecting pipe 16. This discharge muffler 15 is rigidly secured to the cylinder block 10 with a screw 18. A stay 21 is secured to the lower case 1*b* and adapted to support cylinder block 10 through a spring 22.

Figure 6:
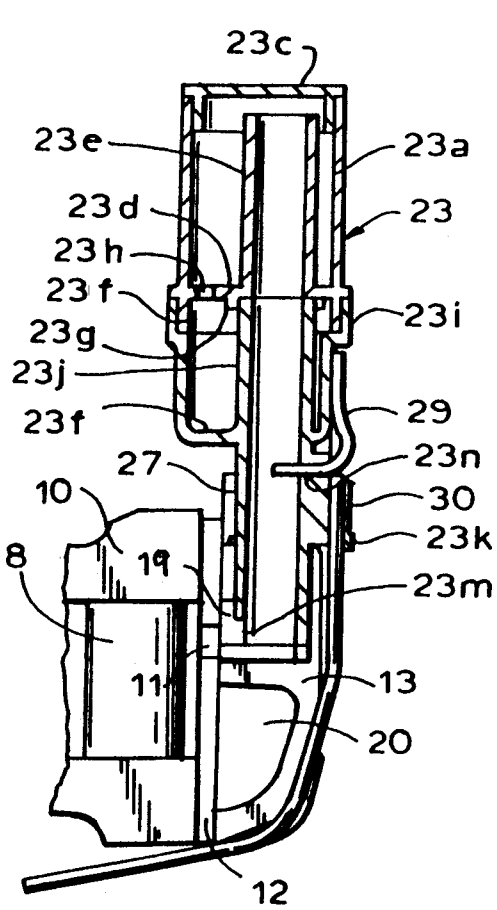
FIG. 6 is a side elevational assembly view showing the suction muffler, cylinder head and cylinder thereof.
Figure 5:
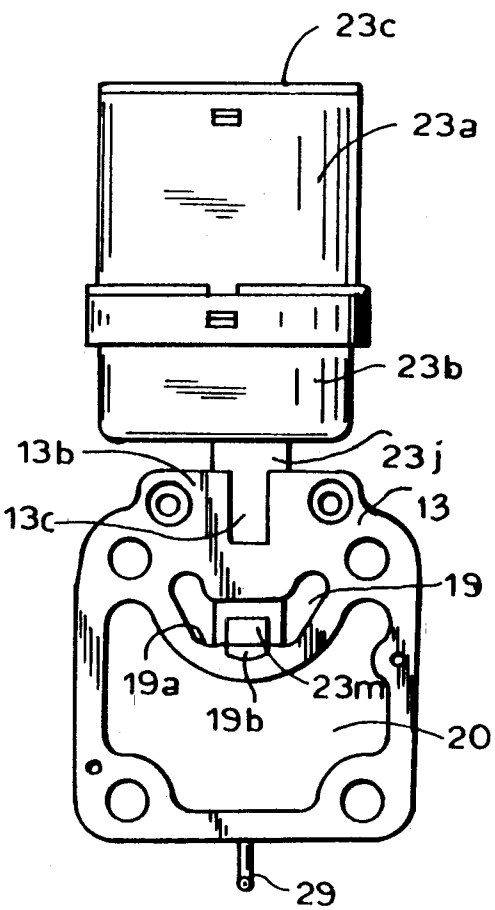
FIG. 5 is a back elevational assembly view showing the suction muffler and cylinder head thereof.
Figure 4:
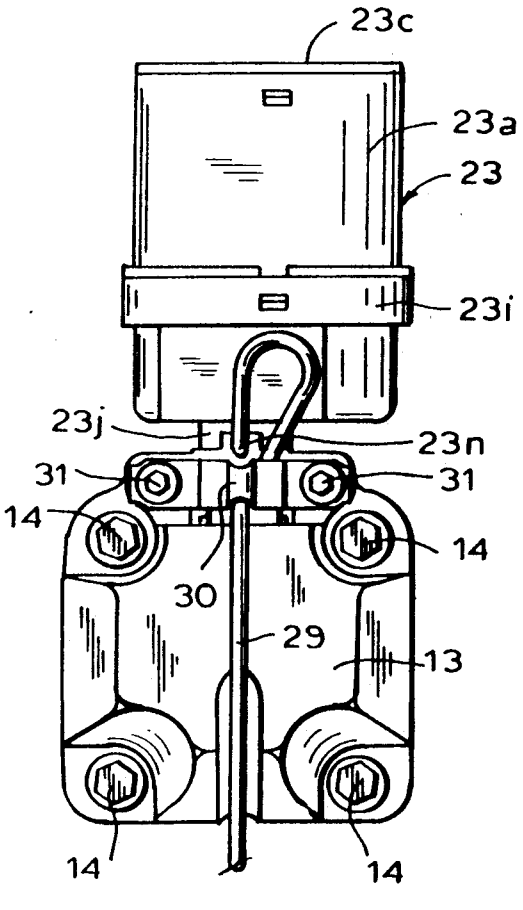
FIG. 4 is a front elevational assembly view showing the suction muffler and cylinder head thereof.

Referring now to FIGS. 5 and 6 in particular, the unitary integrally formed cylinder head 13 has a suction chamber or plenum 19 and a discharge chamber or plenum 20, each of which is formed as a separate recess in cylinder head 13 that is open toward the valve plate 12. The suction chamber 19 is smaller in volume than the discharge chamber 20 and is preferably disposed above the discharge chamber 20.

Suction muffler 23 is made of a synthetic resin of low thermal conductivity, such as polybutylene terephthalate (PBT), and is connected to suction pipe 24 of a cooling system secured to the lower case 1*a*. The connection is accomplished by inserting one end of an insert pipe 25 of generally L-configuration into the suction muffler 23 and connecting the other end of the insert pipe 25 to the suction pipe 24 hermetically through a spring 26.

Referring now to FIGS. 4-7, the suction muffler 23 generally consists of an upper case 23*a*, a lower case 23*b* and a cover 23*c*. The upper case 23*a* has a passageway 23*e* opening at the top and extending upward from a bottom wall 23*d*. A flange 23*f* and another flange 32*g* are formed extending downwardly on the periphery of bottom wall 23*d* and the underside of passageway 23*e*, respectively. The bottom wall 23*d* defines an opening 23*h*. The lower case 23*b* is open at the top thereof and has a peripheral edge 23*i* engaging the peripheral flange 23*f* of the upper case 23*a*. A cylindrical communicating duct 23*j* is formed integrally with lower case 23*b* and has an upstream end which engages flange 23*g* disposed below the passageway 23*e* and a downstream end which extends into the suction chamber 19 (as shown in FIG. 6). The communicating duct 23*j* is in the shape of a cylinder open at both ends and formed with a pair of collars 23*k* (see FIG. 7), both of which abut against planar port 13*a* of the cylinder head 13 so as to control the depth of insertion of the communicating duct 23*j* into the suction chamber 19. A channel 231 is formed between the pair of collars 23*k*.

Figure 7:
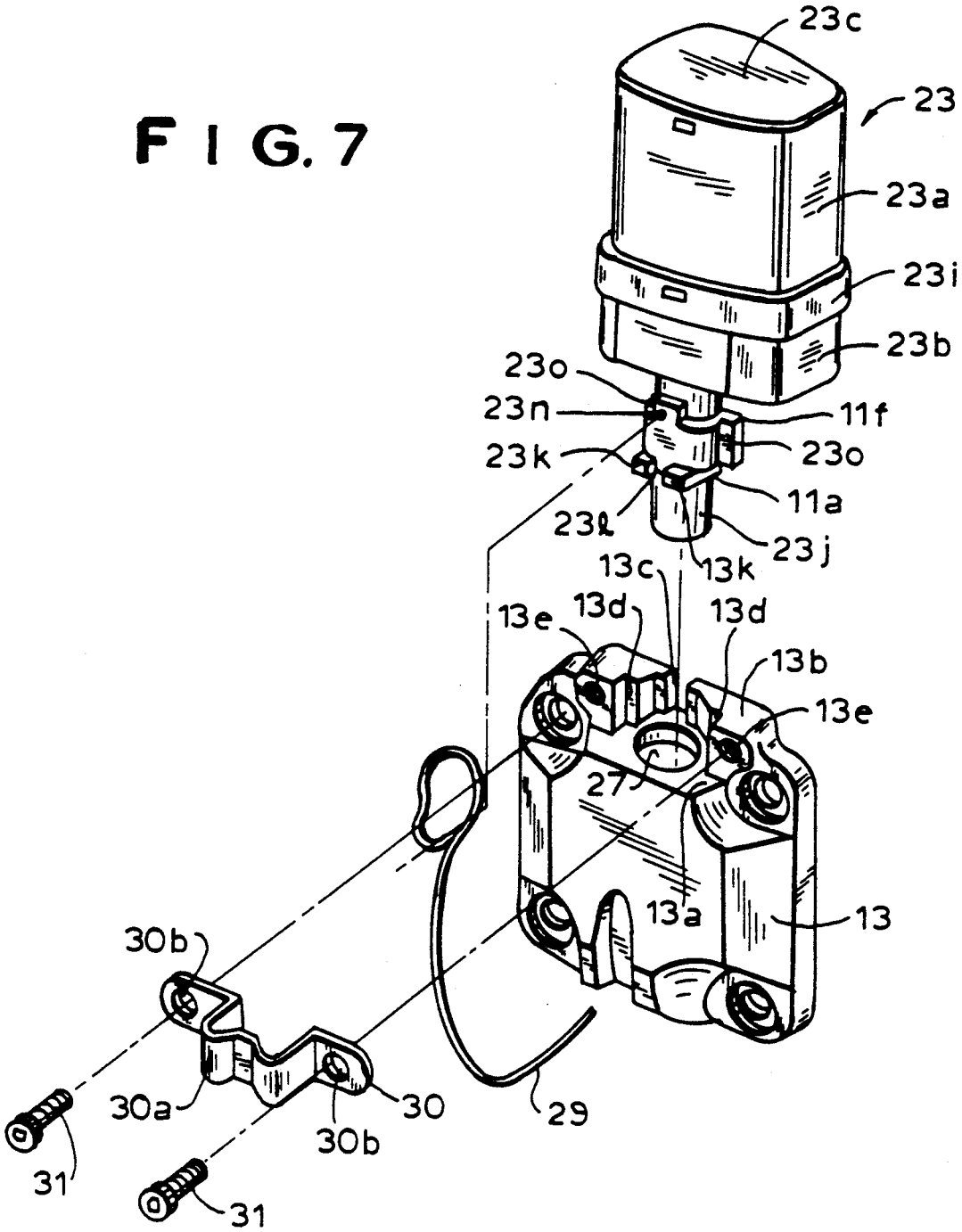
FIG. 7 is an exploded isometric view showing the suction muffler and cylinder head thereof.

Referring to FIGS. 6-7, an upwardly opening cylindrical insertion hole 27 extends from the planar part 13*a* of the cylinder head 13 to the suction chamber 19. The communicating duct 23*j* is inserted into this insertion hole 27. Since the collars 23*k* are larger than the insertion hole 27, the depth of insertion of the communicating duct 23*j* into the suction chamber 19 is self-limited, as mentioned above.

The bottom end of communicating duct 23*j*, within the suction chamber 19 and below the insertion hole 27, is formed with a cutout 23*m* in a position facing the suction port 11 of the valve plate 12. The suction chamber 19 is formed with a planar surface 19*a* in a position facing the end of communicating duct 23*j*, and a channel 19*b* is formed in the planar surface 19*a* below the cutout 23*m* of communicating duct 23*j*, so that the suction gas flowing from the suction muffler 23 is more ready to flow into the suction port 11 than to directly fill up the suction chamber 19.

A small opening 23*n* is formed in communicating duct 23*j* on the side opposite valve plate 12. An oil capillary tube 29 has one end immersed in a lubricating oil 28 in a lower part of the lower case 1*b* and the other end extending into the communicating duct 23*j* through the small opening 23*n*. The oil capillary tube 29 is set in position in channel 231. The piston 8 is thus supplied with lubricating oil 28 via oil capillary tube 29.

A longitudinally planar part 23*o* extends laterally from communicating duct 23*j* (as shown in FIG. 7). A planar surface 13*d* extending from the cylinder head 13 toward the suction muffler 23 is formed in a wall 13*b* disposed adjacent the valve plate 12. This wall 13*b* is cut out at 13*c* in an area intended to abut against the part of communicating duct 23*j* which lies on the valve plate side (see FIGS. 5–7). The wall 13*b* is formed with the planar surface 13*d* for engaging the planar part 23*o* of the communicating duct 23*j* from the suction muffler 23.

A steel band 30 has a spring portion 30*a* in the approximate center thereof. With a bolt 31 fitted into each of threaded holes 13*e* formed in the wall 13*b* of the cylinder head 13, each band end 30*b* is secured to the wall 13*b* so that spring portion 30*a* precludes rotation of the suction muffler 23. It should be understood that the oil capillary tube 29 is also held in position by the steel band 30.

To assemble the suction or intake muffler 23, the upper container 23*a* and lid 23*c* are welded together ultrasonically, and the upper container 23*a* and lower container 23*b* are then fit and secured together. To assemble the cylinder head 13 and the suction muffler 23, the communicating duct or connecting tube 23*j* of suction muffler 23 is inserted into the insertion hole 27 of cylinder head 13. Then the oil capillary 29 is inserted into port 23*n* in the communicating duct 23*j*, with the oil capillary 29 being held in the groove 231. The steel band 30 is next fitted to the cylinder head 13, and bolts 31 securing it to the cylinder head 13 tightened. Finally, the cylinder head 13 is fitted to the cylinder, and screws 14 tightened.

In operation of the hermetic compressor, the refrigerant gas recycled from the cooling system flows through the suction pipe 24, spring 26 and insertion pipe 25 to the suction muffler 23. The refrigerant gas is then sucked into the cylinder 9 through the communicating duct 23*j*, suction chamber 19 and suction port 11. Since the communicating duct 23*j* is made of synthetic resin, the refrigerant gas introduced into the suction chamber 19 is not substantially heated by the cylinder head 13, so that an improvement in compression efficiency is achieved. Furthermore, the refrigerant gas entering the suction chamber 19 is ready to flow from the opening 23*m* of the communicating duct 23*j*, guided by the channel 19*b* of the suction chamber, into the suction port 11, with the result that the conduction of heat from the cylinder 9 to the refrigerant gas in the suction chamber 19 is minimized. The suction chamber 19 serves to provide a somewhat larger volume than the volume of refrigerant gas required for the next compression stroke within the cylinder 9 upon movement of the piston 8, thereby to preclude any shortage in the available suction volume of refrigerant gas.

Since the communicating duct 23*j* is secured to the cylinder head 13 by the steel band 30 and not subject to undue forces, there is no need for special provision for ensuring strength. Moreover, since the planar part 23*o* of the communicating duct 23*j* abuts against the planar part 13*d* of the cylinder head 13, the pipe 23*j* is precluded from rotation, thus eliminating the need for special positioning efforts when assembling. For this very reason, the suction muffler 23 and cylinder head 13 may be preassembled in the factory and, hence, the overall on site assembly work efficiency is greatly improved.

Moreover, since the communicating duct 23*j* need only be passed through the insertion hole 27 and its end need not be in intimate contact with the cylinder head 13, it is not necessary to perform special machining or processing to ensure flatness of the adjacent facing surfaces to prevent gas leaks, thereby eliminating any chance destruction of the communicating duct during an attempt to tighten up the seal. This is a further contributory factor in providing an improved assembly work efficiency in the factory.

Furthermore, the larger size of the collars 23*k* relative to the size of the insertion hole 27 prevents ambient gas from being sucked into the suction chamber 19 through the clearance between the external peripheral wall of the communicating duct 23*j* and the interior peripheral wall of the insertion hole 27, with the result that the generation of annoying suction noise is minimized.

To summarize, the present invention provides a hermetic compressor of improved compression efficiency. An integral unitary one-piece metallic cylinder head defines both the suction chamber and the discharge chamber, but with minimal heating of suction gas in the suction chamber by the hotter gas in the discharge chamber. The suction muffler and cylinder head may be preassembled at the factory to minimize on site assembly work. The suction muffler is held against rotation relative to the cylinder head, and suction noise is minimized.

Now that the preferred embodiments of the present invention have been shown and described in detail, various modifications and improvements thereon will become readily apparent to those skilled in the art. Accordingly, the appended claims should be construed broadly and in a manner consistent with the spirit and scope of the invention herein, and not limited by the foregoing specification.

We claim:

1. A compressor for compressing a fluid comprising:

(A) a compressor unit including a cylinder assembly having a suction port formed therein;

(B) an integral unitary metallic cylinder head secured to said compressor unit and including an insertion hole, a suction chamber communicating with said insertion hole and said cylinder assembly, and a discharge chamber communicating with said cylinder assembly; and (C) a suction muffler secured to said cylinder head and formed of a material of low thermal conductivity for receiving the fluid to be compressed through a fluid inlet port, said suction muffler having a single communicating duct extending through said insertion hole, partially disposed within said suction chamber, and terminating within said suction chamber adjacent said suction port for leading the fluid to be compressed into said cylinder assembly; said communication duct having a sidewall and defining a terminal portion disposed within said suction chamber adjacent said suction port for leading the fluid to be compressed into said cylinder assembly, said terminal portion within said suction chamber adjacent said suction port defining an aperture in said duct sidewall facing said suction port so that the fluid to be compressed is more likely to flow into said suction port than to directly fill up said suction chamber.

2. A compressor according to claim 1 wherein the downstream wall of said suction chamber, which is adjacent the downstream end of said communicating duct, is recessed.

3. A compressor for compressing a fluid comprising:

(A) a compressor unit including a cylinder assembly having a suction port formed therein;

(B) an integral unitary metallic cylinder head secured to said compressor unit and including an insertion hole, a suction chamber communicating with said insertion hole and said cylinder assembly, and a discharge chamber communicating with said cylinder assembly; and (C) a suction muffler secured to said cylinder head and formed of a material of low thermal conductivity for receiving the fluid to be compressed through a fluid inlet port, said suction muffler having a single communicating duct extending through said insertion hole, partially disposed within said suction chamber, and terminating within said suction chamber adjacent said suction port for leading the fluid to be compressed into said cylinder assembly;

said communicating duct being cylindrical, extending through said insertion hole, terminating adjacent a downstream wall of said suction chamber opposite said insertion hole, and having an opening in said suction chamber which faces said suction port.

4. A compressor according to claim 3 wherein said communicating duct includes collar means for limiting the depth of insertion of said communicating duct into said insertion hole and therefore into said suction chamber.

5. A compressor according to claim 3 wherein said collar means in use effects a substantially hermetic seal between said communicating duct and said insertion hole.

6. A cylinder head and suction muffler assembly for a compressor unit in a hermetic compressor including a suction port, said cylinder head being adapted to be secured to a compressor unit and having an insertion hole, a suction chamber formed in said cylinder head and communicating with said insertion hole and for communicating with the suction port, and a discharge chamber formed in said cylinder head for communicating with the compressor unit, said suction muffler being adapted to receive the fluid to be compressed through a fluid inlet port and having a single communicating duct extending through said insertion hole and being partially disposed in said suction chamber for conveying the fluid to said suction chamber; said communicating duct having a sidewall and defining a terminal portion disposed within said suction chamber adjacent the suction port for leading the fluid to be compressed into said cylinder head, said terminal portion within said suction chamber adjacent the suction port defining an aperture in said duct sidewall facing the suction port so that the fluid to be compressed is more likely to flow into the suction port than to directly fill up said suction chamber.

7. An assembly according to claim 6 wherein said communicating duct includes collar means for limiting the depth of insertion of said communicating duct into said insertion hole and therefore into said suction chamber.

8. An assembly according to claim 7 wherein said collar means in use effects a substantially hermetic seal between said communicating duct and said insertion hole.

9. An assembly according to claim 6 additionally including a closed housing, and a compressor unit and an electric drive unit which are resiliently supported within said housing.

10. An assembly according to claim 6 wherein said cylinder head is metallic and said suction muffler is made of a material of low thermal conductivity.

11. An assembly according to claim 6 wherein said first and second surfaces are flat.

12. An assembly according to claim 6 wherein said cylinder head has a wall portion defining a first surface, said communicating duct being formed with a second surface abutting against said first surface, and a resilient band biasing said first and second surfaces together for fixing said communicating duct in position relative to said cylinder head against relative rotation and precluding separation of said suction muffler and said suction chamber of said cylinder head.

* * * * *